US012559275B2

(12) United States Patent
Tsoutsoulis

(10) Patent No.: US 12,559,275 B2
(45) Date of Patent: Feb. 24, 2026

(54) PACKAGING FOR WHEEL RIMS

(71) Applicant: WILLOWTREE HOLDINGS PTY LTD, Point Cook (AU)

(72) Inventor: Angelo Tsoutsoulis, Point Cook (AU)

(73) Assignee: WILLOWTREE HOLDINGS PTY LTD, Point Cook (AU)

( * ) Notice: Subject to any disclaimer, the term of this patent is extended or adjusted under 35 U.S.C. 154(b) by 0 days.

(21) Appl. No.: 18/534,326

(22) Filed: Dec. 8, 2023

(65) Prior Publication Data

US 2025/0187769 A1 Jun. 12, 2025

(51) Int. Cl.

| | |
|---|---|
| ***B65B 33/02*** | (2006.01) |
| ***B65B 25/24*** | (2006.01) |
| ***B65B 61/06*** | (2006.01) |
| ***B65D 85/06*** | (2006.01) |

(52) U.S. Cl.

CPC ..... *B65B 33/02* (2013.01); *B65B 25/24* (2013.01); *B65B 61/06* (2013.01)

(58) Field of Classification Search

CPC ..... B62D 43/005; B62D 43/02; B65B 25/24; B65B 33/02; B65B 61/06; B65D 85/06

USPC ..... 206/303, 304, 304.1, 304.2, 398–402

See application file for complete search history.

(56) References Cited

U.S. PATENT DOCUMENTS

| | | | | |
|---|---|---|---|---|
| 1,406,601 A * | 2/1922 | Anderson | B62D 43/00 | 206/304 |
| 1,500,472 A * | 7/1924 | Scherner | B65D 85/06 | 206/304 |
| 1,755,133 A * | 4/1930 | Wallace | B65D 85/06 | 206/304.1 |
| 2,754,960 A * | 7/1956 | Bloss | B65D 85/06 | 206/304 |
| 2,754,961 A * | 7/1956 | Wilson | B65D 85/06 | 206/304 |
| 8,499,931 B2 * | 8/2013 | Hsi | B65D 85/06 | 206/303 |

FOREIGN PATENT DOCUMENTS

AU 2023202540 11/2023

OTHER PUBLICATIONS

IP Australia Application Details Report for AU2023202540, report generated Dec. 19, 2025.

* cited by examiner

*Primary Examiner* — Bryon P Gehman

(74) *Attorney, Agent, or Firm* — Heslin Rothenberg Farley & Mesiti P.C.; George S. Blasiak, Esq.

(57) ABSTRACT

Packaging for a wheel 10 is provided that has a cylindrical rim 11 and first and second cylindrical flanges 12, 13 extending from opposite axial ends of the rim 11. The packaging comprising first and second sleeves 22, 44 in which the first sleeve 22 extends about the rim 11 and bears against a facing surface of the first flange 12 and the second sleeve 44 extends about the rim 11 and extends through the first sleeve 22, extending past the first flange 12 to form a support surface 66 spaced from the first flange 12. A method of packaging a wheel and a bulk package for shipping is also provided.

19 Claims, 5 Drawing Sheets

PACKAGING FOR WHEEL RIMS

TECHNICAL FIELD

The present Invention relates to packaging for automotive wheels. The present invention has been developed for packaging wheels for transport and is particularly suitable for high value wheel that have facing surfaces that require protection during transport.

BACKGROUND OF INVENTION

The discussion of the background to the invention that follows is intended to facilitate an understanding of the invention. However, it should be appreciated that the discussion is not an acknowledgement or admission that any aspect of the discussion was part of the common general knowledge as at the priority date of the application.

Wheels for automotive vehicles include basic wheels of low value that are usually made of steel. These wheels can employ decorative hub caps to overlie and hide or obscure the wheel nuts and studs that attach the wheel to the vehicle stub axle. Wheels of higher value usually include spokes that have outwardly facing surfaces that are visible when the wheel is fitted to a vehicle and that are designed add to the aesthetic appeal of wheels and to the appearance of the vehicle in general. These forms of wheels can be made from steel or aluminium alloys and are now relatively standard even on medium priced vehicles. Wheels of higher value again are made of carbon fibre. These wheels have equivalent strength and stiffness to steel or aluminium alloy wheels, but are much lighter than those metal wheels and thus are beneficial to the vehicle in lowering overall weight. These wheels are very attractive for high performance vehicles, where weight is of critical importance.

The visible facing surfaces of the wheel needs to be protected during transport so that they are not scratched or otherwise damaged during transport. This is particularly important where the wheels are expensive and where consumers will expect the visible facing surfaces to be completely free of defects or blemishes.

The manufacture of specialty wheels occurs in a small number places and countries and this is particularly the case for carbon fibre wheels, which involve highly specialised materials, equipment and processes. The manufacturers of such wheels export their wheel rims around the world. Attention to the manner in which the wheels are packaged for transport is important to reduce damage to the wheels that occurs during transport, noting that the transport of wheels is mainly by cargo ship and with multiple wheels loaded onto stacked pallets. The wheels are thus often subject to difficult transport conditions and if the packaging is not sufficiently protective, then the manufacturer can be faced with the cost of replacement and no guarantee that the replacement wheels will themselves arrive at their destination undamaged.

One form of current packaging is made from fluted cardboard and comprises top and bottom trays each of which has a base and walls extending from the base to form a square or rectangular interior for accommodating a wheel. The trays are dimensioned to be a close fit about the wheel and they include supporting inserts to engage and support a wheel that is packaged within the trays and to limit movement of the wheel within the trays. The wheel is packaged in a standing up orientation in which the axis about which the wheel will rotate when fitted to a vehicle is generally horizontal. A single wheel is first placed in the bottom tray and the walls of the tray extend upwardly about the bottom portion of the wheel to a position close to, but just short of the mid-point of the wheel. The top tray is then placed over the upper portion of the wheel, again to a position close to, but just short of the mid-point of the wheel. Facing edges of the top and bottom trays do not engage when the top and bottom trays are fitted to a wheel. This ensures that the internal supporting inserts remain in engagement with the wheel.

The above-described packaging substantially encloses the wheel within the top and bottom trays. Only a very small horizontal section of the wheel at the mid-point of the wheel is not enclosed. However, the walls of the top and bottom trays that overlie the visible facing surfaces can come into contact with those surfaces during transport and that contact can damage those surfaces.

The present invention has been developed to provide improved packaging for wheels, in particular to protect the visible facing surfaces of wheels.

SUMMARY OF INVENTION

The present invention relates to packaging for a vehicle wheel, in particular a wheel that is susceptible to surface damage during transport, such as a wheel that has a visible facing surface that requires protection during transport. The present invention provides packaging for a wheel in which the wheel is oriented so that the axis about which the wheel will rotate when fitted to a vehicle is generally vertical and the visible facing surface that requires protection during transport faces upward. The packaging according to the present invention includes a sleeve or work apron (hereinafter "sleeve") that extends about the wheel in general coaxial alignment with the wheel and the sleeve has a bottom edge that rests on a loading surface on which the wheel rests, or on a flange or lip of the wheel that rests on that loading surface. The sleeve also presents an upper edge positioned above the visible facing surface of the wheel. The upper edge of the sleeve can support an object placed on the upper edge spaced from the visible facing surface of the wheel to protect the visible facing surface from contact with the object. The object might be a second packaged wheel, or a sheet on which a second packaged wheel might be placed, or a lid of a box or a container that the packaged wheel is contained or stored in.

The packaging according to the invention can thus protect the visible facing surface of the wheel, by providing a protective space above the visible facing surface so that contact with the visible facing surface during the time the wheel is packaged is prevented. The packaging can also protect other surfaces of the wheel, such as the surface that is opposite the visible facing surface. This is relevant for wheels that consumers expect to be unmarked prior to purchase and includes carbon fibre wheels as discussed above. This applies even to surfaces that are concealed once the wheel is fitted to a vehicle, given that the consumer will often select a wheel prior to a tyre being fitted to it and prior to the wheel being fitted to a vehicle, and surface marks or other damage can result in a consumer rejecting a wheel.

The packaging according to the present invention thus can comprise a single sleeve. In other forms of the invention, the packaging according to the can comprise first and second sleeves. Accordingly, in one specific form of the present invention there is provided packaging for a wheel that has a cylindrical rim and first and second cylindrical flanges extending from opposite axial ends of the rim, the packaging comprising first and second sleeves:

a. the first sleeve extending about the rim and bearing against a facing surface of the first flange, b. the second sleeve extending through the first sleeve and extending about the rim and bearing against a facing surface of the second flange, the second sleeve extending past the first flange to form a support surface spaced from the first flange.

Packaging according to the invention advantageously forms a support surface for supporting other objects, such as other wheels, or a substrate on which other wheels can be loaded, for example a cardboard sheet, whereby the support surface can be spaced from or above the visible facing surface of the wheel, so that the visible facing surface of the wheel can be protected by that spacing during transport. The spacing of the support surface from the visible facing surface of the wheel means that there can be movement of the wheel within the packaging without necessarily the visible facing surface coming into contact with other objects supported on the support surface so that there is a greater likelihood that the wheel will arrive at its destination with the visible facing surface undamaged.

The packaging of the present invention is intended for use (but is not exclusively for use) with the wheel in an orientation in which the axis about which the wheel will rotate when fitted to a vehicle is generally vertical. This can be termed a "lying down" orientation. In this orientation, the visible facing surface of the wheel can be the surface of the wheel which faces upwards and can be the visible faces of the spokes of a wheel that extend from the rim to a central hub. Advantageously, the spacing of the support surface from the first flange is can be spacing above the visible facing surface of the wheel, so that the visible facing surface can be protected from engagement with the packaging during transport and storage.

The packaging of the present invention can be made from any suitable materials, but it has been developed as being suitable for manufacture from corrugated or fluted cardboard. This includes double wall corrugated BC flute commonly known as "BC flute" or "twin cushion BC".

The first and second flanges are alternatively known as inner and outer rim lips and inner surfaces of the rim lips engage with the beads of a tyre to secure the tyre to the wheel. The first and second sleeves can be of the same diameter or of different diameter, but if they are of different diameter then the difference in diameter will be small.

The first and second flanges are spaced apart from each other to suit the size of tyre that will be fitted to the wheel. The first and second flanges have inner and outer faces. One of the first and second flanges will be on the same side of the wheel as the visible facing surfaces of the wheel.

The first flange of a wheel can be the flange that is axially on the same side of the wheel as the visible facing surface of the wheel. The first sleeve will engage the first flange on an inner or underneath surface of the first flange that faces away from the visible facing surface. The first sleeve can have an engagement edge for engaging the first flange in a substantially continuous manner or it can engage the first flange in a discontinuous or interrupted manner.

The second sleeve extends through or passes through the first sleeve and in some forms of the invention, the second sleeve connects to, or alternatively interacts or engages with the first sleeve. The second sleeve presents the support surface spaced from the visible facing surface of the wheel for supporting other objects. In some forms of the invention, when the support surface of the second sleeve is loaded, the second sleeve transfers that loading, or a portion of that loading, to the first sleeve. The first sleeve will then react that load and in some forms of the invention, the first sleeve engages the surface on which the wheel rests and so the load is reacted by that engagement. The first sleeve can for example, extend about the external periphery of the second flange and rest against or on the same surface as the second flange rests, or in fact, the same surface as the wheel rests. The first sleeve will thus transfer load to that surface.

In other forms of the invention, the second sleeve can be configured for bearing against or resting on the same surface as the second flange rests, or as above, the same surface as the wheel rests. In this arrangement, when the support surface of the second sleeve is loaded the second sleeve will then react that load by engagement with the surface on which the wheel rests. The second sleeve can for example, extend about the external periphery of the second flange to rest against or on the same surface as the second flange rests, or on the same surface as the wheel rests. In this arrangement, each of the first and second sleeves can extend about the external periphery of the second flange and rest against or on the same surface as the second flange rests, or in fact, the same surface as the wheel rests.

The preferred arrangement at this stage however is that the second sleeve is configured for bearing against a facing surface of the second flange when it is connected to the first sleeve. In this form of the invention, the first sleeve bears against the first flange and the second sleeve bears against the second flange so that when the support surface of the second sleeve is loaded, the second sleeve transfers loading to the second flange, noting that the connection between the first and second sleeves can result in some form of load transfer between them.

In the preferred arrangement described above, the first sleeve can be a generally cylindrical sleeve of a greater diameter than the cylindrical rim of the wheel, but having a slight incline or conical or tapered shape so that one edge of the first sleeve can engage the inside of the first flange but the opposite edge can. The slight incline or conical shape of the first sleeve will allow the first sleeve to engage the inside of the first flange and extend past the second flange given that the first and second flanges typically have the same outer diameter. The first sleeve could rest on the inside of the second flange, but in the preferred arrangement, there may be insufficient room for each of the first and second sleeves to rest on the inside of the second flange.

In some forms of the invention, the first sleeve extends past the second flange so as to elevate the wheel, or suspend the wheel above a loading surface on which the packaged wheel is placed. The bottom edge of the first sleeve thus rests or bears against the loading surface and the second flange is spaced from the loading surface. This also elevates the wheel surface that is adjacent the second flange, or in other words, the inside wheel surface that is opposite the visible facing surface, above the loading surface and thus protects the inside wheel surface from surface damage during transport in a similar manner to the protection provided to the visible facing surface. The first sleeve can be formed from sheet material, such as sheet cardboard, and so the first sleeve can be cut from a sheet blank, such as a cardboard blank. The first sleeve can be formed with suitable creases or slits to enable it to be easily formed to a cylindrical sleeve with suitable end engagements at each end of the blank to connect opposite ends together. Likewise, the second sleeve can be formed from sheet material, such as sheet cardboard, and so the second sleeve can be cut from a sheet blank, such as a cardboard blank. The second sleeve can be formed with suitable creases or slits to enable it to be easily formed to a cylindrical sleeve with suitable end engagements at each end of the blank to connect opposite ends together. The end engagements can be quite simple and in some forms of the invention, can be simple slot engagements.

The second sleeve has been described above as extending through the first sleeve. Alternatively, it could be said that the first sleeve extends through the second sleeve. Regardless, the first and second sleeves interact so that both sleeves can engage a respective flange of the wheel while still extending at their opposite ends to the required position, which for the first sleeve can be to the second flange, or to the loading surface. For the second sleeve, this is to the position above the visible facing surface.

In some forms of the present invention, the first and second sleeves interact so that there is bearing engagement between the first and second sleeves such that when the support surface of the second sleeve is loaded, there is a load transfer of at least some of that load to the first sleeve. For this, the first and second sleeves can include bearing surfaces that cooperate when the support surface of the second sleeve is loaded, so that load from the second sleeve can be transferred to the first sleeve via the cooperating bearing surfaces.

In some forms of the invention, one of the first and second sleeves includes an opening and the other of the first and second sleeves includes an engagement member suitable to enter the opening and to extend though the first sleeve. This can connect the first sleeve to the second sleeve. The engagement member can enter the opening axially simply by the second sleeve being lowered over the wheel relative to the first sleeve. This can advantageously facilitate easy connection of the first and second sleeves.

While a single engagement member can be provided, the first sleeve can alternatively include at least a pair of openings. These can be diametrically opposed to each other. Alternatively, the first sleeve can include three, four or more openings and can for example, include a ring of openings.

The second sleeve can include the same number of engagement members as the first sleeve includes openings, for example two, three, four or more engagement members. Alternatively, the second sleeve can include a lesser number of engagement members compared to the number of openings of the first sleeve. In this arrangement, the greater number of openings compared to the number of engagement members may make fitting of the second sleeve to the first sleeve easier by not requiring alignment of each engagement member with an opening.

In some forms of the invention, the first sleeve includes a ring of openings, such as 10 openings and the second sleeve includes the same number of engagement members.

The engagement members can extend from shoulders and the openings can have a facing edge so that with the engagement members inserted through the openings, the shoulders can engage the facing edge to bring the first and second sleeves into bearing engagement so that the shoulders and the facing edge become cooperating bearing surfaces. This bearing engagement can facilitate load from the second sleeve being transferred to the first sleeve as discussed above. The engagement members can take any suitable form. The second sleeve can for example comprise a continuous sleeve portion and the engagement members can extend from a bottom edge of the sleeve portion. The engagement members can be individual members so that each engagement member is spaced apart from an adjacent engagement member. The spacing between adjacent engagement members will be dependent on the spacing of the openings formed in the first sleeve.

The second sleeve can be formed to have a conical shape so that it can bear against a facing surface of the second flange and so that it can extend past the first flange to form a support surface spaced from the first flange and usually spaced above the first flange.

The present invention also provides a method of packaging a wheel and this can involve placing a wheel on a loading surface so that the axis of the wheel about which the wheel will rotate when fitted to a vehicle is generally vertical, and fitting a sleeve about the wheel in general coaxial alignment with the wheel so that a bottom edge of the sleeve that rests on a loading surface on which the wheel rests, or on a flange or lip of the wheel that rests on that loading surface. The sleeve presents an upper edge positioned above the visible facing surface of the wheel so that the upper edge of the sleeve can support an object placed on the upper edge spaced from the visible facing surface of the wheel to protect the visible facing surface from contact with the object.

The method of packaging a wheel can include first and second sleeves, the method including fitting the first sleeve about the cylindrical rim so that it bears against a facing surface of the first flange of the wheel, fitting a second sleeve about the rim so that the second sleeve extends past the first flange to form a support surface above the first flange. The first and second sleeves can be fitted to interact as described above.

It is envisaged that if the first sleeve is formed as a blank, such as a cardboard blank, the blank will be curved about the cylindrical rim and once in position about the cylindrical rim, the opposite ends of the first sleeve can be connected together. The second sleeve can also be formed as a blank and curved about the cylindrical rim and then the opposite ends of the connected together. Alternatively, the opposite ends of the second sleeve can be connected together and then the second sleeve can be placed into position about the cylindrical rim. For example, where the first sleeve includes openings for engagement members of the second sleeve to enter, if entry to the openings of the first sleeve is at a position that is outside the diameter of the first flange the second sleeve can alternatively be formed as a sleeve before application to the wheel and before connection to the first sleeve.

The present invention thus also provides a packaged wheel in which the wheel has a cylindrical rim and first and second axially spaced flanges extending from opposite edges of the rim, the packaging comprising first and second sleeves:

i. the first sleeve extending about the rim and bearing against a facing surface of the first flange,
ii. the second sleeve extending about the rim and bearing against a facing surface of the second flange, the second sleeve extending past the first flange and forming a support surface to support an object placed on the support surface spaced from the first flange.

The packaging for the packaged wheel described above can be of any of the kinds discussed above. Importantly, the wheel that is packaged can be suspended above a loading surface on which the packaged wheel is loaded. This can be by the first sleeve extending past the second flange so as to elevate the wheel, or suspend the wheel above the loading surface on which the packaged wheel is placed in the manner described previously herein.

The packaged wheel described above can be a single package that is shipped in isolation. This might happen when a wheel of a vehicle is damaged and the packaged wheel is sent as a replacement for the damaged wheel.

Alternatively, the packaged wheel can be one of a plurality of packaged wheels that are transported in bulk. The packaging of the present invention has been developed with bulk transport in mind and with the possibility that wheels can be packaged within standard shipping containers at greater density and thus provide greater efficiency. Prototype packaging according to the invention can allow for six wheels to be packed in one layer on a pallet and for three layers to be stacked on each pallet. In a standard shipping container, two pallets stacked in this manner can be stacked on top of each other. Each pallet thus contains 18 wheels and the shipping container can accept 18 pallets stacked 2 high. The container thus has capacity to accept 324 wheels. This compares to existing arrangements in which containers have capacity to accept 160-240 wheels.

Accordingly, the present invention provides a bulk package for shipping comprising:

a. a pallet supporting on an upper base surface thereof, a first set of six packaged wheels of the above-described kind in a pattern of 3×2, a first divider supported on the support surfaces of the second sleeves of each packaged wheel of the first set of packaged wheels, b. a second set of six packaged wheels of the above-described kind in a pattern of 3×2 supported on an upper surface of the first divider, a second divider supported on the support surfaces of the second sleeves of the second set of packaged wheels, c. a third set of six packaged wheels of the above-described kind in a pattern of 3×2 supported on an upper surface of the second divider.

The bulk package thus forms three layers of packaged wheels, with each layer comprising six packaged wheels and dividers being supported on the support surfaces of the second sleeves of the packaged wheels. As indicated above, a standard shipping container can accept eight pallets along its length and two pallets high.

The divider between layers of packaged wheels can be a sheet, although it can alternatively be a lid that closes a tray within which the 3×2 packaged wheels are contained. The tray can accept the six packaged wheels for placement onto the pallet and the lid can be placed over the tray. The lid can still be supported on the support surfaces of the second sleeves of the packaged wheels, but the benefit of the lid and tray arrangement is the confinement of the packaged wheels against movement off the pallet. In alternative arrangements, the stacked pallet could be shrink-wrapped but the use of the lid and tray arrangement will provide improved protection for the packaged wheels by further enclosing them within a protective container.

Further protection can be provided by the use of inserts within the lid and tray arrangement to fit between the packaged wheels, such as between adjacent pairs of packaged wheels. Insert could alternatively be employed between each adjacent packaged wheel so in the 3×2 configuration, there are two inserts positioned between the three sets of two pairs of packaged wheels and there is a single insert positioned between the two sets of three packaged wheels so that the respective inserts are perpendicular to each other.

It is to be noted that it is within the scope of the present invention that a bulk package for shipping comprises just the first set of six packaged wheels, or just the first and second sets of six packaged wheels as described above. Moreover, where transport regulations allow, additional sets of six packaged wheels could be added subject to the second sleeves of the packaged wheels being sufficiently strong to support the load of the additional layers.

An alternative a bulk package can have a bulk sleeve that extends about the full height of the stacked sets of packaged wheels so that each layer of packaged wheels does not have its own tray and lid. The stacked sets of packaged wheels can still be separated by dividers and in some forms of the invention, a tray is placed on the pallet and packaged wheels are assembled within the tray and dividers are placed between stacked sets of packaged wheels. Inserts can be positioned between the packaged wheels in each stack of packaged wheels. A lid can be placed over the uppermost set of packaged wheels and supported on the support surfaces of the second sleeves of the uppermost set of packaged wheels and the bulk sleeve can extend fully about the stacked sets of packaged wheels and upper and lower edges can be secured within the tray and lid, interposed between the walls of the tray and lid and the packaging of the adjacent packaged wheels of the lowermost and uppermost sets of packaged wheels.

Where the packaged wheels are stacked on a pallet according to the arrangements discussed above, the bulk package can be strapped or shrink wrapped to hold all of the components together.

Reference hereinbefore to a loading surface on which a wheel can be loaded is to be understood to be a transport tray, such as the tray of a truck, or a surface of a pallet, or on another packaged wheel, or on a sheet or lid overlying a packaged wheel or a set of packaged wheels, such as described above in relation to bulk packaging for transport. The packaging of the present invention is very suitable for stacking as would be apparent from the discussion above and so a lower packaged wheel can form a loading surface for an upper packaged wheel although typically, a substrate or panel would be interposed between vertically adjacent packaged wheels.

BRIEF DESCRIPTION OF DRAWINGS

In order that the invention may be more fully understood, some embodiments will now be described with reference to the figures in which.

DETAILED DESCRIPTION

Figure 1:
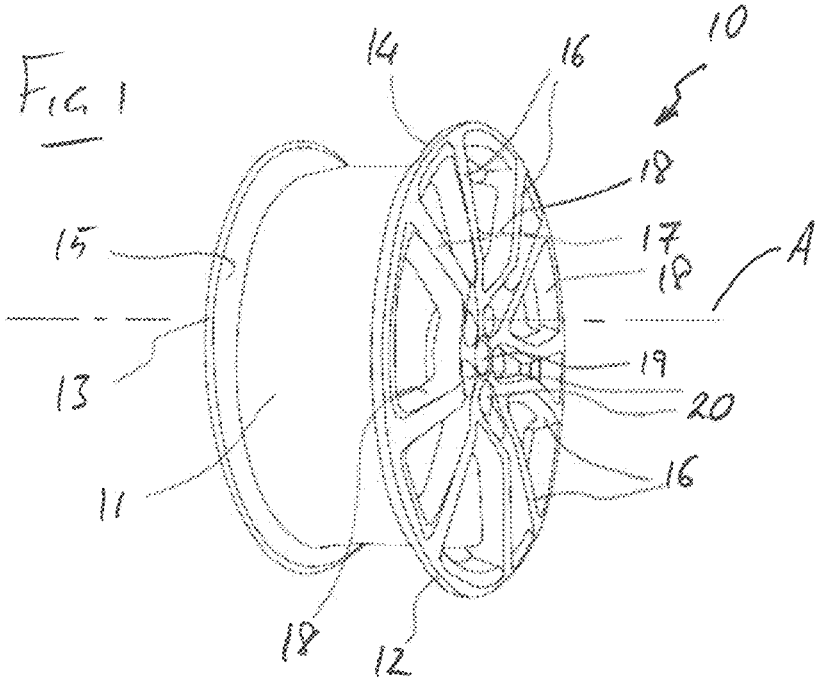
FIG. 1 is a perspective side view of a wheel of the kind which can be packaged by packaging of the present invention.

FIG. 1 is a view of an example wheel of the kind to be packaged by the packaging of the present invention. The wheel 10 of FIG. 1 has a cylindrical barrel or rim 11, a first flange or lip 12 and a second flange or lip 13. The wheel 10 has an axis A about which the wheel 10 will rotate when fitted to a vehicle and in FIG. 1, the axis A is generally horizontal. In the orientation of the wheel 10 shown in FIG. 1, in which the axis A is generally horizontal, the wheel 10 can be said to be in a "standing up" orientation.

The respective first and second flanges 12 and 13 have approximately the same outer diameter and each flange has inner surfaces 14 and 15 against which a tyre which is fitted to the wheel 10 presses. A person skilled in the art would be familiar with the fitting of a tyre to the wheel 10.

The second flange 13 is largely obscured from view when the wheel 10 is fitted to a vehicle as it is positioned well inside the wheel well of the vehicle. Accordingly, there is little concern about the aesthetic appearance of the flange 13 and so protection of the flange 13 during transport is not a primary consideration.

The first flange 12 is positioned adjacent to the spokes 16 and it is the spokes 16 which are largely visible when the wheel 10 is fitted to a vehicle. The spokes 16 form a decorative feature of the wheel 10 and the vehicle itself and it is therefore important that the visible surfaces of the spokes 16 (hereinafter referred to as the "visible facing surfaces"), are protected from defects or blemishes until the wheel is fitted to a vehicle and the vehicle owner takes responsibility for the condition of the wheel 10. The visible facing surfaces of the spokes 16 are often highly polished and scratches and marks are easily visible.

The spokes 16 have outward facing visible surfaces 17 and inclined or perpendicular facing surfaces 18, all of which are visible to an outside observer of a vehicle to which the wheel 10 is fitted. It is these surfaces that are the prime concern for protection during transport and storage by the packaging of the present invention.

It is to be noted that the visible facing surfaces of the wheel 10 could be other than formed on spokes, although spokes are a very common in the types of wheels that the present invention has been developed for. Other examples of visible facing surfaces include disc surfaces in which the circular area between the flange 12 and the hub 19 is formed solid with a pattern applied to the outwardly facing surface. The pattern could be a series of openings formed in the disc.

Each of the spokes 16 extends from the rim 11, or the first flange 12 (or a combination of the two), inwardly to the hub 19 and in FIG. 1, it can be seen that the hub 19 includes five stud openings 20 for receipt of studs to secure the wheel 10 to a stub axle of a vehicle. The hub 19 also includes surfaces that require protection.

Figure 2:
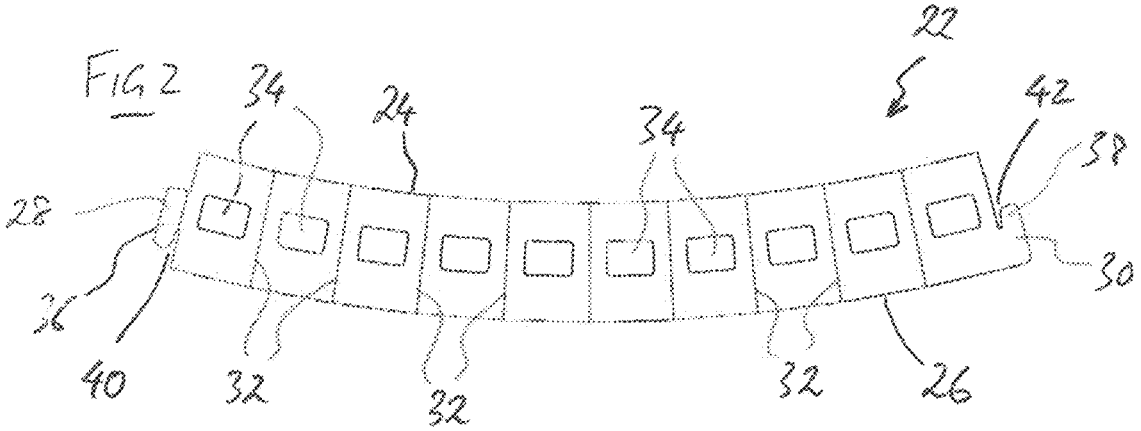
FIG. 2 is a plan view of a first sleeve blank forming part of the packaging of the present invention.
Figure 3:
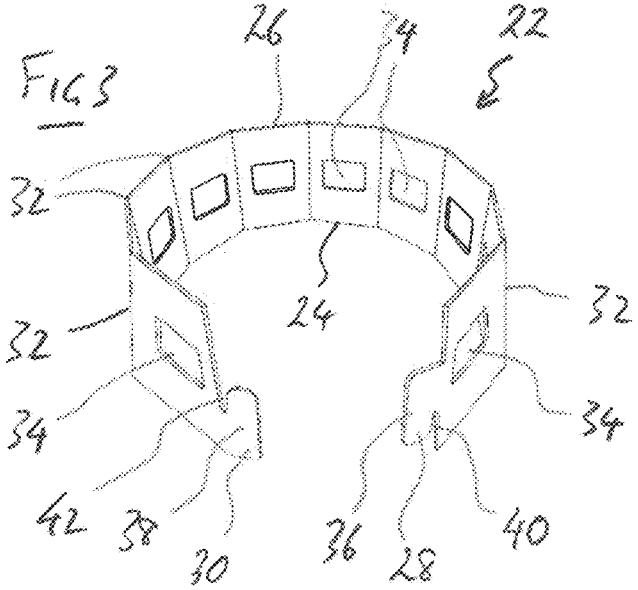
FIG. 3 is a partially assembled view of the sleeve of FIG. 2.

The packaging according to the present invention comprises first and second sleeves that connect together to surround the wheel 10 about the rim 11 and to protect the visible facing surfaces of the wheel 10. The first and second sleeves can be formed of any suitable material, but they have been designed in prototypes to be made from corrugated or fluted cardboard and to be die cut from cardboard blanks. FIG. 2 shows the first sleeve 22 in blank form, while FIG. 3 shows the sleeve 22 in a substantially curved configuration, while finally, FIG. 4 shows the sleeve 22 applied to the wheel 10.

The first sleeve 22 includes a first edge 24, a second edge 26 and connectable opposite ends 28 and 30. The sleeve 22 includes a series of vertical slits 32 and between adjacent slits, ten rectangular openings 34 are provided. The vertical slits facilitate folding of the sleeve 22 in the manner shown in FIGS. 3 and 4.

The ends 28 and 30 are formed with cooperating connectors 36 and 38 and it will be readily apparent to a person skilled in the art, that the groove 40 formed in the connector 36 can cooperate with the groove 42 formed in the connector 38 to connect the connectors 36 and 38 together and thus to form the sleeve 22 into a circular sleeve.

Figure 4:
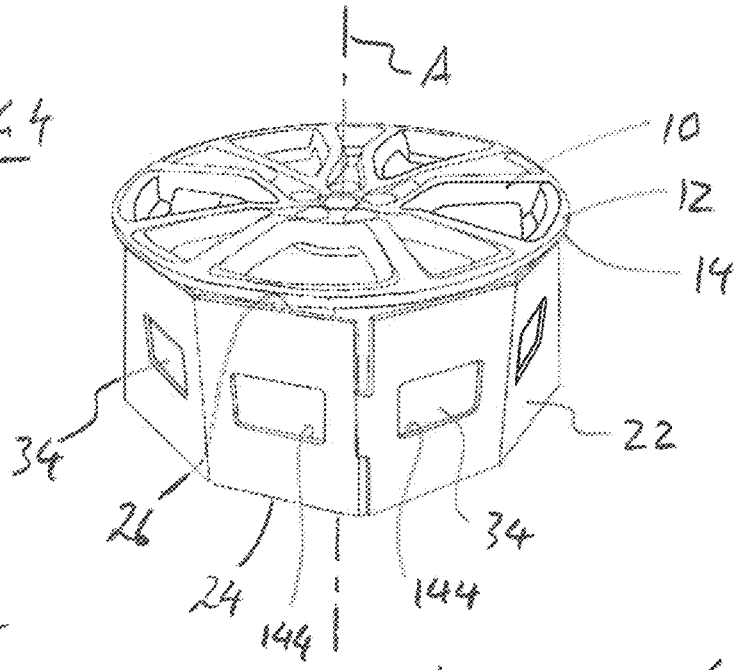
FIG. 4 is a view of the wheel of FIG. 1 with the sleeve of FIGS. 2 and 3 applied to it.

FIG. 4 shows that the axis A of the wheel 10 has been shifted 90 degrees from the position of FIG. 1, so that the wheel 10 can be said to be in a "lying down orientation". FIG. 4 also shows the sleeve 22 extending about the rim 11 of the wheel 10 with the connectors 36 and 38 connected (although the actual connection is obscured in FIG. 4), and it can be seen that the second edge 26 of the sleeve 22 is positioned in contact or engagement with the inner facing surface 14 of the first flange 12 of the wheel 10. The first edge 24 is positioned past the second flange 13 and would be seated or resting on or bearing against the surface on which the wheel 10 is positioned. The second edge 26 of the sleeve 22 can be arranged to support the flange 13 above that surface, thus suspending the wheel 10 above the surface, or the second edge 26 and the flange 13 can both rest on the surface. The latter arrangement is appropriate if protection of the surfaces of the flange 13 is not a priority. In those circumstances, it is not necessary for the sleeve 22 to elevate the wheel 10 above the supporting surface, but it is important that there be firm engagement between the edge 26 of the sleeve 22 and the inner surface 14 of the flange 12.

Figure 5:
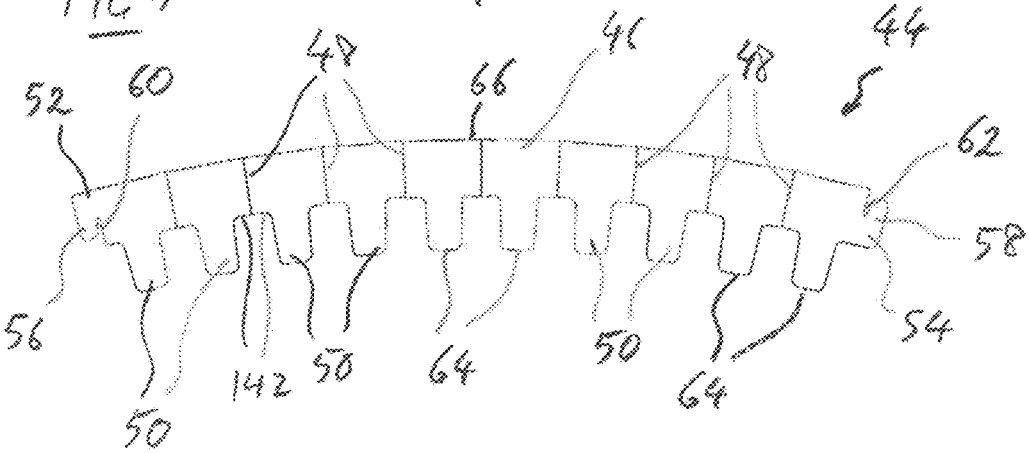
FIG. 5 is a plan view of a second sleeve blank forming part of the packaging of the present invention.
Figure 6:
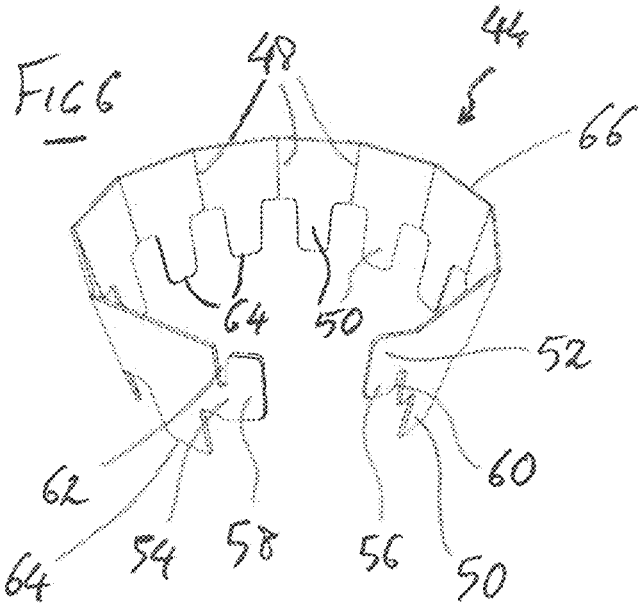
FIG. 6 is a partially assembled view of the sleeve of FIG. 5.

A second sleeve of the packaging according to the present invention is illustrated in FIG. 5 in the same flat, blank form that the sleeve 22 is shown in FIG. 2. In FIG. 5, the sleeve 44 has a continuous sleeve portion 46 that includes a series of adjacent and generally vertical slits 48 and the sleeve 44 further has a plurality of equidistantly spaced apart engagement members 50. The sleeve 44 has opposite ends 52 and 54 and those opposite ends include respective connectors 56 and 58 and each of the connectors includes a respective groove 60, 62. The connectors 56 and 58 are intended to connect together in the same way as the connectors 36 and 38 of the sleeve 22 when the sleeve 44 is curved into a substantially cylindrical shape as shown in FIG. 6.

Figure 7:
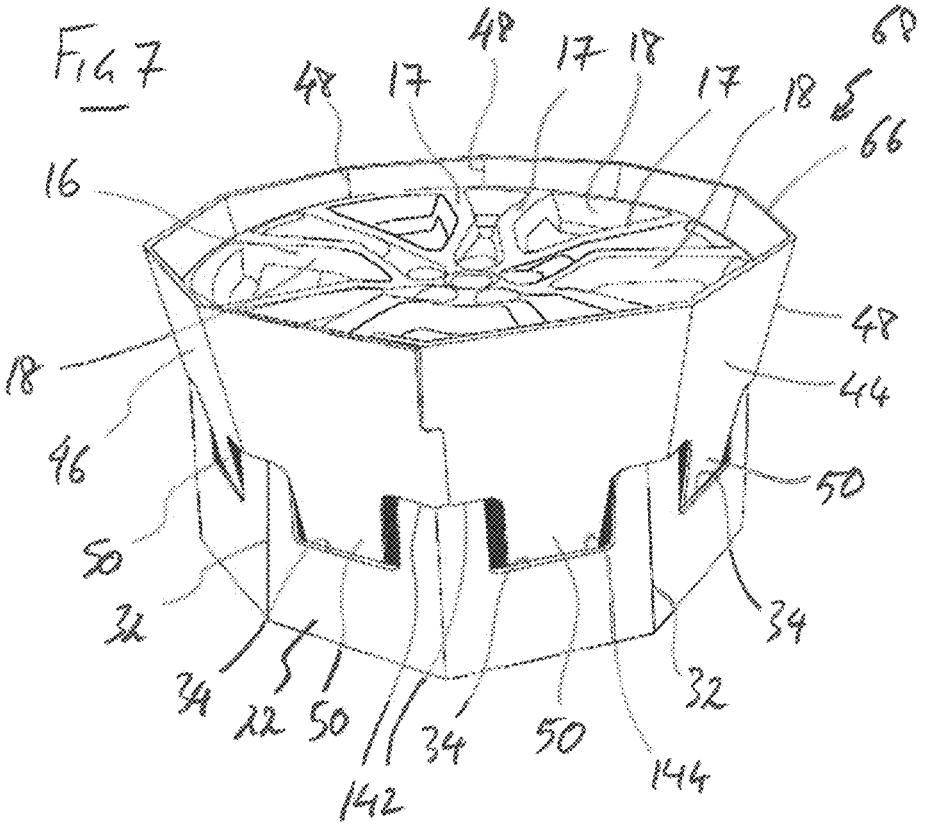
FIG. 7 shows the wheel of FIG. 1 with the sleeves of FIGS. 2 and 5 applied to it.

FIG. 7 shows the connectors 56 and 58 connected together (although the actual connection is obscured in FIG. 7), so that the sleeve 44 is now circular and in FIG. 7, the sleeve 44 is connected to the sleeve 22 by the engagement members 50 having been inserted through the openings 34 of the sleeve 22. This forms a packaged wheel 68. What is not visible in FIG. 7 because the bottom ends of the engagement members 50 of the sleeve 44 are obscured, is that the engagement members 50 extend all the way into contact with the inner surface 15 of the second flange 13, so that the distal ends 64 of the engagement members 50 (see FIG. 5), bear against the inner surface 15 of the second flange 13. With that bearing contact, the sleeve 44 is able to support a load that is placed on the upper edge 66 of the sleeve 44, so that the upper edge 66 forms a support surface for supporting a load that is placed onto it.

Further, it can be seen that the edge 66 of the sleeve 44 is positioned above the surfaces 17 and 18 of the spokes 16 of the wheel 10, so that a load can therefore be supported on the edge 66 spaced away from or above the surfaces 17 and 18. By this arrangement, the surfaces 17 and 18 can be protected during transport and storage.

Figure 12:
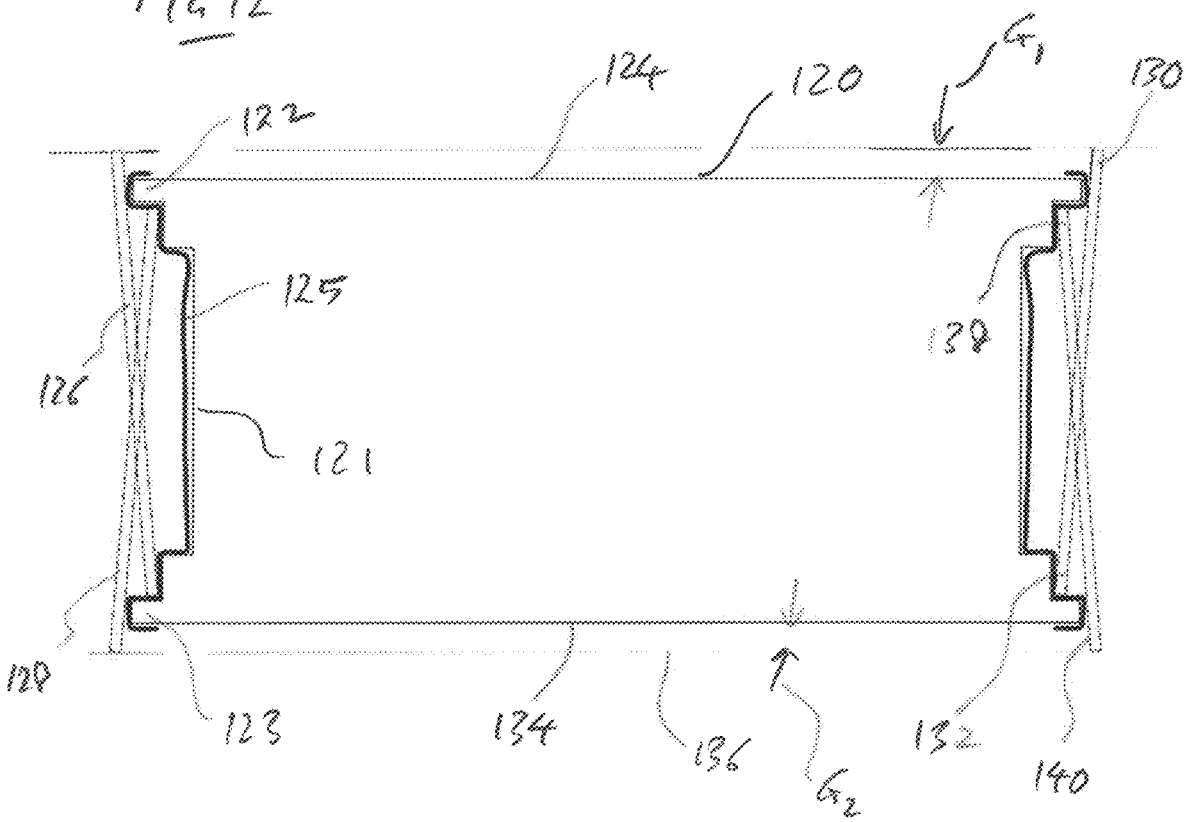
FIG. 12 is a side view of a wheel assembly having protective foam wrapping and first and second sleeves arranged to suspend the wheel above a loading surface or transport protection.

It can be seen from FIG. 7, that the sleeve 44 is inclined or conical, and this occurs as a result of the need for the ends 64 of the engagement members 50 to seat on the inner surface 15 of the flange 13 of the wheel 10, but to extend upwardly and past the outer edge of the flange 12. The sleeve 44 therefore needs to have a slightly conical shape to position the edge 66 in the position shown in FIG. 7, spaced above the spoke surfaces 17 and 18. FIG. 12 described later herein shows the interaction between the two sleeves and the wheel and shows an embodiment of the invention in which the wheel is suspended above a loading surface rather than resting on the loading surface.

Figure 8:
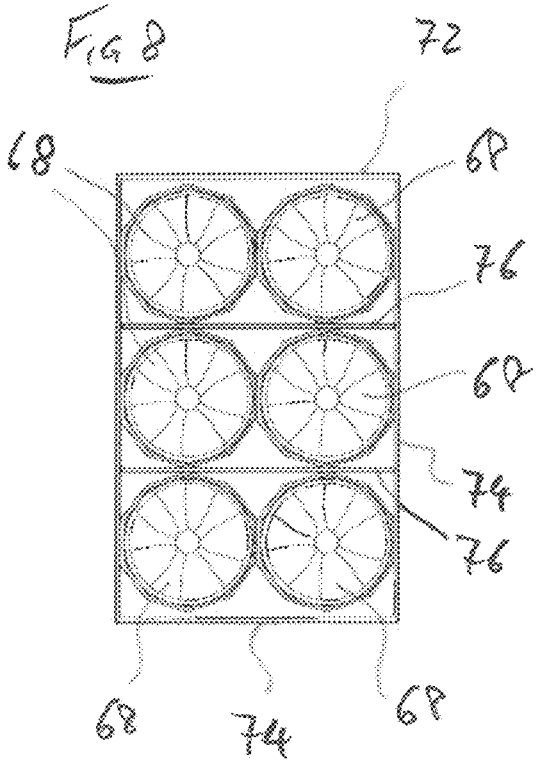
FIG. 8 is a plan view of an example pattern of packaged wheels applied to a pallet.

The packaged wheel 68 as shown in FIG. 7 has been developed for efficient transport within a shipping container and FIG. 8 shows six packaged wheels 68 of FIG. 7 which are arranged on a pallet 70 (see FIG. 9) within a tray 72. The tray 72 includes upstanding end and side walls 74 which extend upwardly to just below the upper edge 66 (see FIG. 7) of the sleeve 44 so that the upper edge 66 extends higher than the upper edge of the walls 72. FIG. 8 shows that the packaged wheel of FIG. 7 is arranged in three pairs and that inserts 76 are positioned between the respective pairs.

Figure 9:
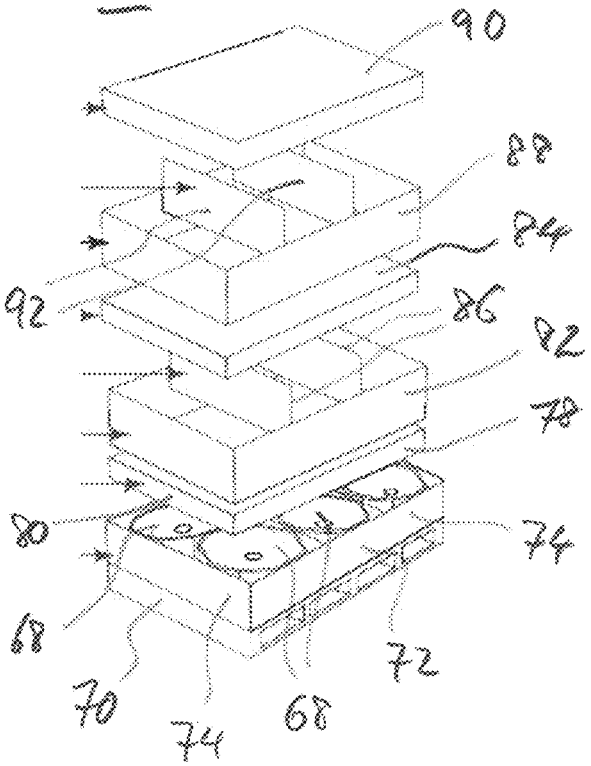
FIG. 9 is a perspective exploded view of an example stacking of packaged wheels on a pallet.

With respect to FIG. 9, a lid 78 can be placed over the tray 72, with the side walls 80 of the lid 78 extending about the outside of the walls 74 of the tray 72 and the lid rests on the edges 66 of the six packaged wheels 68.

The upper edges 66 of the panels 44 thus support the lid 78 and the lid 78 is located on the tray 72. The tray 72 confines the packaged wheels 68 to the pattern shown in FIG. 8, which has a footprint of about the same size as the pallet 70.

Several layers of packaged wheels 68 can be loaded onto the pallet 70 as shown in FIG. 9. Accordingly, a second tray 82, lid 84 and inserts 86 is shown in exploded view above the lid 78. The tray 82 can be placed on top of the lid 78 when the lid 78 is supported on the edges 66 of the packaged wheels 68 and a further six packaged wheels 68 can be inserted into the tray 82 with the inserts 86 interposed between pairs of packaged wheels in the same pattern as shown in FIG. 8. The lid 84 can be lowered onto the tray 82 to rest on the upper edges 66 of the packaged wheels 68 located within the tray 82. A further layer of packaged wheels 68 can be loaded into the tray 88, with the lid 90 and inserts 92 being provided in the same manner as the tray 82, lid 84 and inserts 86 described below. The stacked trays can be strapped or shrink wrapped to secure the three layers together.

Figure 10:
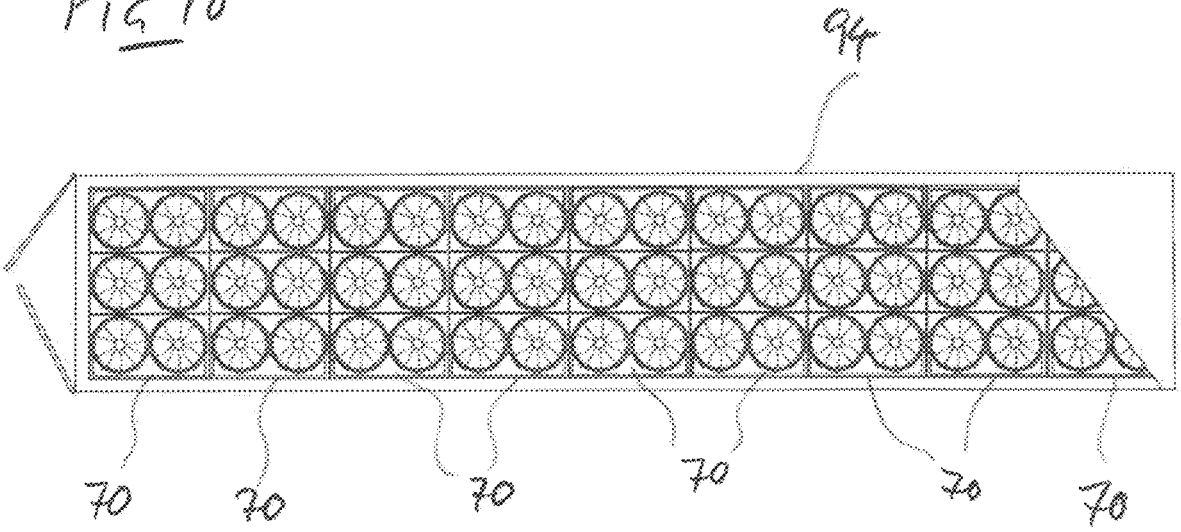
FIG. 10 shows an example stacking pattern of packaged wheels within a shipping container.

In a shipping container, the layered stack shown in FIG. 9 can be stacked two high, so that a second assembly of FIG. 9 can be placed on the first assembly of FIG. 9, so that six layers of packaged wheels 68 are stacked vertically together. As shown in FIG. 10, a shipping container 94 can accommodate nine pallets 70 along its length and with the pallets stacked two high within the container 94, 16 pallets with a total of 288 wheels can be packaged within the container 94.

Figure 11:
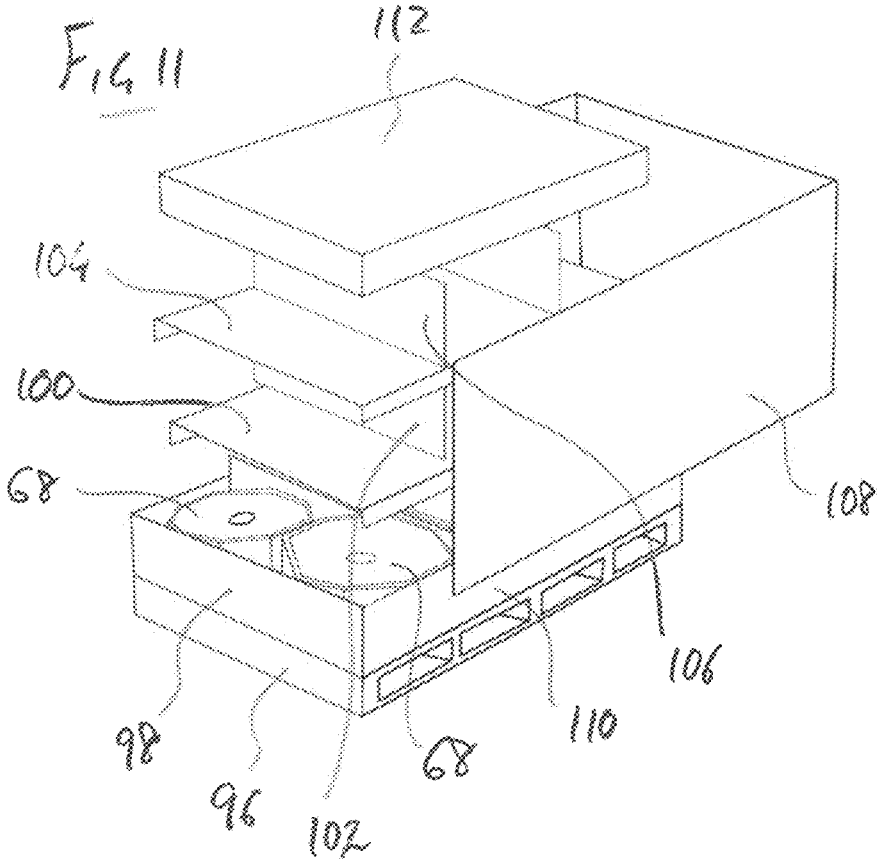
FIG. 11 is a perspective exploded view of a second example stacking of packaged wheels on a pallet.

FIG. 11 shows an alternative packaging method, which includes a pallet 96 and a tray 98 which are similar to, or the same as the pallets 74 and the tray 72 of FIG. 9. Six packaged wheels 68 are loaded within the tray 98 in the same configuration as shown in FIG. 8. A sleeve 100 can then be placed on the edges 66 of the packaged wheels 68 and with inserts 102 in place, a second layer of packaged wheels 68 can be loaded onto the sleeve 100. A second sleeve 104 and inserts 106 can be placed over the second layer of packaged wheels 68 and a further layer of packaged wheels 68 can be applied to the sleeve 104. With the three layers now in place on the pallet 96, a sleeve 108 can be placed inside the tray 98 interposed between the side wall 110 of the tray 98 and the packaged wheels 68 and the sleeve 108 extends upwardly to a position which is just below the edges 66 of the third layer of packaged wheels 68. One sleeve 108 is shown in FIG. 11, and this can be an L-shaped sleeve and so a second L-shaped sleeve can be added so that all four sides of the packaged wheels 68 are enclosed.

Once the sleeves 108 have been positioned, the lid 112 can be fitted over the upper level of packaged wheels 68 to rest on the edges 66 of those packaged wheels 68 and then the stacked pallet can be strapped or shrink wrapped. Again, a second pallet having the same stacked arrangement as shown in FIG. 11 can be stacked on top of the lid 112. The assembly as shown in FIG. 11 can be loaded into the container 94 of FIG. 10 to contain the same number of packaged wheels 68 as in the packaging arrangement of FIG. 9.

FIG. 12 shows a wheel 120 which can be of the same form as the wheel 10 of the earlier figures. The wheel 120 has a cylindrical barrel or rim 121, a first flange or lip 122 and a second flange or lip 123. A visible facing surface 124 is formed adjacent the first flange 122.

The wheel 120 has a protective foam wrap 125 that extends about the rim 121 and the first and second flanges 122, 123. The foam is a thin flexible foam that can be wrapped around the wheel 120 and secured by tape (not shown).

First and second sleeves 126 and 128 are shown in place against the wheel 120 in a similar manner to the first and second sleeves 22 and 44 shown in FIG. 7. However, FIG. 12 shows that the top edge 130 of the first sleeve 126 extends above the visible facing surface 124 to create a gap G1 so that the top edge 130 forms a support surface spaced from the visible facing surface 124. This is the same arrangement as shown in FIG. 7.

The bottom edge 132 of the first sleeve 126 engages the inner facing surface of the second flange 123 so that load placed on the first sleeve 126 is transferred to the second flange 123.

The top edge of the second sleeve 128 engages the inner facing surface of the first flange 122 while the bottom edge 140 of the second sleeve 128 extends below the bottom face 134 of the wheel 120 and engages the loading surface 136 to create a gap G2 so that the bottom edge 140 suspends the wheel 120 above the loading surface 136.

FIG. 12 thus shows how a wheel 120 can be completely suspended above a loading surface 136 to protect both the visible facing surface and the bottom surface opposite the visible facing surface from surface damage during transport.

Moreover, testing has established that the arrangement of FIG. 12 can protect a packaged wheel during significant transport of hundreds and even thousands of kilometres road transport. The same result is expected for sea transport. In particular and with reference to FIG. 7, it has been found that if the engagement members 50 and the openings 34 are arranged so that the (see also FIG. 5) bear against the corner edges 144 (see also FIG. 4) of the openings 34, there can be a cushioning or vibration dampening during movement of the packaged wheel. What is thought to occur is that at least some of the load that is imposed on the first sleeve 126 is transmitted through the shoulders 142 to the corner edges 144 so that load transfers to the second sleeve 128 and that load pushes up against the first flange 122. This load transfer seems to minimise the load applied to the as the expected damage to the foam wrap 125 has not occurred. The expectation is that by the interacting as discussed above, load applied to the first and second sleeves 126 and 128 is low so that the majority of load must be transferring to the loading surface 136. The absence of damage to the foam wrap 125 at the first and second sleeves 126 and 128 means that surface damage to the first and second sleeves 126 and 128 is unlikely, thus adding to the benefit provided by the present invention.

Where any or all of the terms "comprise", "comprises", "comprised" or "comprising" are used in this specification (including the claims) they are to be interpreted as specifying the presence of the stated features, integers, steps or components, but not precluding the presence of one or more other features, integers, steps or components.

Those skilled in the art will appreciate that the invention described herein is susceptible to variations and modifications other than those specifically described. It is understood that the invention includes all such variations and modifications which fall within the spirit and scope of the present invention.

The invention claimed is:

1. Packaging for a wheel that has a cylindrical rim and a first cylindrical flange and a second cylindrical flange extending from opposite axial ends of the rim, the packaging comprising a first sleeve and a second sleeve:

i. the first sleeve extending about the rim and bearing against a facing surface of the first flange, ii. the second sleeve extending about the rim and extending through the first sleeve extending past the first flange to form a support surface spaced from the first flange.

2. Packaging according to claim 1, the second sleeve being cut from a sheet blank, and having end engagements at each end of the blank to connect opposite ends together.

3. Packaging according to claim 1, the second sleeve being configured for bearing against or resting on a supporting surface that the second flange also rests on.

4. Packaging according to claim 1, the second sleeve being configured for bearing against or resting on a facing surface of the second flange.

5. Packaging according to claim 1, the first sleeve being a generally cylindrical sleeve of a greater diameter than the cylindrical rim of the wheel, and being inclined or tapered so that one edge of the first sleeve can engage the facing surface of the first flange and the opposite edge can extend past the second flange to engage or rest on a supporting surface that the second flange also rests on.

6. Packaging according to claim 1, the first sleeve being a generally cylindrical sleeve of a greater diameter than the cylindrical rim of the wheel, and being inclined or tapered so that one edge of the first sleeve can engage the facing surface of the first flange and the opposite edge can extend past the second flange to engage or rest on a supporting surface and to elevate or suspend the wheel above the supporting surface.

7. Packaging according to claim 1, the second sleeve being releasably connectable to or interactive with the first sleeve.

8. Packaging according to claim 7, one of the first sleeve and the second sleeve including an opening and the other of the first sleeve and the second sleeve including an engagement member suitable to enter the opening for connection or interaction between the first sleeve and the second sleeve.

9. Packaging according to claim 8, the engagement member entering the opening axially by the second sleeve being lowered over the wheel relative to the first sleeve.

10. Packaging according to claim 8, a leading end of the engagement member bearing against or resting on a facing surface of the second flange.

11. Packaging according to claim 1, the second sleeve being a generally cylindrical sleeve of a greater diameter than the cylindrical rim of the wheel, and being inclined or tapered so that it can bear against a facing surface of the second flange and so that it can extend past the first flange to form a support surface spaced from the first flange.

12. A method of packaging a wheel that has a cylindrical rim and a first cylindrical flange and a second cylindrical flanges extending from opposite axial ends of the rim, including:

i. placing a wheel on a supporting surface so that the axis of the wheel about which the wheel will rotate when fitted to a vehicle is generally vertical and so the first flange is spaced from the supporting surface and the second flange proximal to or rests on the supporting surface, ii. fitting a first sleeve about the cylindrical rim so that it bears against a facing surface of the first flange of the wheel, iii. bringing a second sleeve into connection or interaction with the first sleeve so that the second sleeve extends about the rim and extends through the first sleeve and past the first flange to form a support surface above the first flange.

13. A method of packaging a wheel according to claim 12, the step of fitting a first sleeve about the cylindrical rim so that it bears against a facing surface of the first flange of the wheel including lifting the wheel above the supporting surface and placing the first sleeve on the supporting surface so that the wheel is elevated or suspended above the supporting surface.

14. A packaged wheel in which the wheel has a cylindrical rim and a first cylindrical flange and a second cylindrical flange extending from opposite edges of the rim, the wheel being placed on a supporting surface and oriented such that an axis about which the wheel will rotate when fitted to a vehicle is generally vertical and so the first flange is spaced from the supporting surface and the second flange is proximal to or rests on the supporting surface, packaging for the packaged wheel comprising a first sleeve and a second sleeve:

i. the first sleeve extending about the rim and bearing against a facing surface of the first flange, ii. the second sleeve extending about the rim and extending through the first sleeve and bearing against a facing surface of the second flange or against the supporting surface on which the wheel is placed, the second sleeve extending past the first flange and forming a support surface to support an object placed on the support surface spaced from the first flange.

15. A bulk package for shipping comprising:

i. a pallet supporting on an upper base surface thereof, a first set of six packaged wheels according to claim 14 in a pattern of 3×2, a first divider supported on the support surfaces of the second sleeves of each packaged wheel of the first set of packaged wheels, ii. a second set of six packaged wheels according to claim 14 in a pattern of 3×2 supported on an upper surface of the first divider, a second divider supported on the support surfaces of the second sleeves of the second set of packaged wheels.

16. A bulk package according to claim 15, a tray being supported on the upper base surface of the pallet and first set of six packaged wheels being placed within the tray.

17. A bulk package according to claim 16, the divider between layers of packaged wheels being a lid that closes a tray within which the 3×2 packaged wheels are contained.

18. A bulk package according to claim 15, the first set of six packaged wheels and second set of six packaged wheels defining stacked sets of packaged wheels, the bulk package including a bulk sleeve that extends about the full height of the stacked sets of packaged wheels.

19. A bulk package according to claim 18, a tray being supported on the upper base surface of the pallet and first set of six packaged wheels being placed within the tray and a divider being placed between the first and second sets of six packaged, a lid being placed over the uppermost set of packaged wheels and the bulk sleeve extending fully about the stacked sets of packaged wheels and upper and lower edges being secured within the tray and lid.

* * * * *